US008955949B2

(12) United States Patent
Tsukamoto

(10) Patent No.: US 8,955,949 B2
(45) Date of Patent: Feb. 17, 2015

(54) INK CIRCULATION APPARATUS, INK CIRCULATION METHOD AND INKJET RECORDING APPARATUS

(71) Applicant: FUJIFILM Corporation, Tokyo (JP)

(72) Inventor: Ryuji Tsukamoto, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/244,182

(22) Filed: Apr. 3, 2014

(65) Prior Publication Data

US 2014/0300670 A1 Oct. 9, 2014

(30) Foreign Application Priority Data

Apr. 5, 2013 (JP) ..... 2013-079606

(51) Int. Cl.
*B41J 2/175* (2006.01)
*B41J 2/18* (2006.01)
*B41J 2/19* (2006.01)

(52) U.S. Cl.
CPC ..... *B41J 2/175* (2013.01)
USPC ..... 347/85; 347/89; 347/92

(58) Field of Classification Search
CPC .... B41J 2/175; B41J 2/17596; B41J 2/17509; B41J 2/17513; B41J 2/1752; B41J 2/18; B41J 2202/12; B41J 2/17556; B41J 2/19
See application file for complete search history.

(56) References Cited

FOREIGN PATENT DOCUMENTS

| | | | |
|---|---|---|---|
| JP | 05-017712 | A | 1/1993 |
| JP | 2006-110780 | A | 4/2006 |
| JP | 2008-132701 | A | 6/2008 |

OTHER PUBLICATIONS

Machine Translation of JP 2006-110780A, Apr. 27, 2006, Paragraphs 0014-0037.*

* cited by examiner

*Primary Examiner* — Lisa M Solomon
(74) *Attorney, Agent, or Firm* — Studebaker & Brackett PC

(57) ABSTRACT

An object of the invention is to prevent, both bubbles and particles from being generated, when circulating ink in an inkjet head. The object can be achieved by an ink circulation apparatus, including: an ink tank that accumulates radical polymerization-type UV-curing ink so as to be in contact with gas including at least oxygen; an inkjet head; oxygen removing means that removes oxygen from the radical polymerization-type UV-curing ink; and control means that changes a mode between a first mode of removing oxygen from the radical polymerization-type UV-curing ink by the oxygen removing means and a second mode of not removing oxygen from the radical polymerization-type UV-curing ink and changes a mode from the first mode to the second mode before electric power of the apparatus is cut off.

14 Claims, 11 Drawing Sheets

(FIG. 11 Continued)
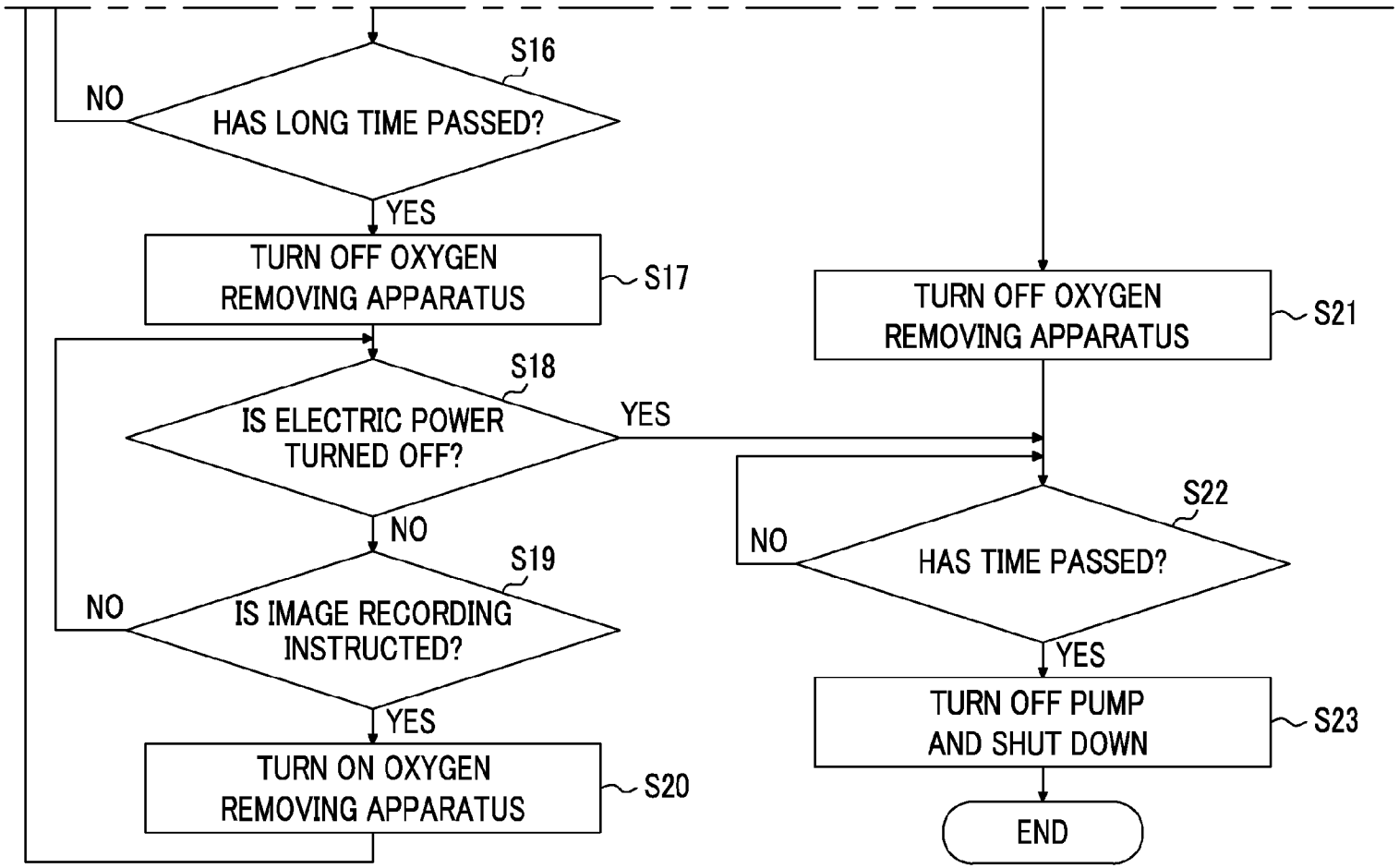

INK CIRCULATION APPARATUS, INK CIRCULATION METHOD AND INKJET RECORDING APPARATUS

BACKGROUND OF THE INVENTION

1. Field of the Invention

The present invention relates to an ink circulation apparatus, an ink circulation method, and an inkjet recording apparatus, and particularly to a technique of preventing a defected nozzle of the inkjet head from being generated.

2. Description of the Related Art

In the inkjet recording apparatus, if bubbles or dissolved gas exists in ink, the ink may not be sufficiently compressed when being ejected, so the ejection property is decreased, and the ink flow is not stable. Accordingly, dot omission or defective printing may occur.

In order to solve the problems above, in JP1993-17712 (JP-H5-17712), a technique of transmitting dissolved gas in ink through a layer having a transmitting property and removing the gas is disclosed. According to the technique, gas can be easily removed even from ink generating bubbles and ink having a volatile component.

Meanwhile, it is known that in radical polymerization-type UV-curing ink, when removing gas from the ink, an oxygen amount in the ink is decreased and the ink is thickened (viscosity is increased)(JP2008-132701).

In order to prevent the radical polymerization-type UV-curing ink from being thickened, JP2006-110780 discloses an inkjet recording apparatus, that includes a gas removing unit that removes dissolved gas from ink supplied to an ink chamber and a gas supply unit that supplies gas to the ink supplied to the ink chamber. When the inkjet head performs the ejection operation, the gas removing unit is driven and controlled so that ink from which the dissolved gas is removed fills the ink chamber, and when the inkjet head does not perform the ejection operation, the gas removing unit is driven and controlled so that ink to which gas is supplied fills the ink chamber.

According to the technique, if the inkjet head performs the ejection operation, the ink from which the dissolved gas is removed fills the ink chamber, so bubbles caused by dissolved gas in the ink chamber can be suppressed from being generated. If an inkjet recording apparatus does not perform the ejection operation, the ink to which gas is supplied and in which dissolved gas is increased fills the ink chamber, so the ink in the ink chamber is not easily cured, and particles caused by the cured ink can be suppressed from being generated.

SUMMARY OF THE INVENTION

Ink is thickened when a solvent of ink evaporates at a nozzle. A technique of providing an ink circulating path in the vicinity of the nozzle and circulating the ink in the nozzle in order to prevent the ink from being thickened has been known. However, the technique of circulating the ink in this manner may not be applied to the technique of JP2006-110780.

In view of the circumstances as above, an object of the invention is to provide an ink circulation apparatus, an ink circulation method, and an inkjet recording apparatus that can simultaneously prevent the generation of bubbles in ink, the thickening of ink, and the generation of particles when radical polymerization-type UV-curing ink is circulated in an inkjet head.

To achieve the above-described object, there is provided an ink circulation apparatus, including: an ink tank that accumulates radical polymerization-type UV-curing ink so as to be in contact with gas including at least oxygen; a supplying flow path that communicates with the ink tank and a supply port of an inkjet head including the supply port to which the radical polymerization-type UV-curing ink is supplied, a nozzle that ejects the radical polymerization-type UV-curing ink, and a discharge port from which the radical polymerization-type UV-curing ink that is not ejected from the nozzle is discharged; a supply pump that is provided in the supplying flow path, and supplies the radical polymerization-type UV-curing ink accumulated in the ink tank to the inkjet head; oxygen removing unit that is provided in the supplying flow path, and removes oxygen from the radical polymerization-type UV-curing ink; a discharging flow path that communicates with the discharge port of the inkjet head and the ink tank; a collecting pump that is provided in the discharging flow path and collects the radical polymerization-type UV-curing ink discharged from the discharge port to the ink tank; and control unit that changes a mode between a first mode of removing oxygen from the radical polymerization-type UV-curing ink by the oxygen removing unit and a second mode of not removing oxygen from the radical polymerization-type UV-curing ink and changes a mode from the first mode to the second mode before electric power of the apparatus is cut off.

According to this aspect, since oxygen is removed from radical polymerization-type UV-curing ink to be supplied to the inkjet head in the first mode, bubbles are prevented from being generated in the inkjet head so dot omission or defective printing may not occur. Further, before electric power of the apparatus is cut off, since ink is circulated without removing oxygen from the ink by changing a mode from the first mode to the second mode, the gas including at least oxygen and the ink are in contact with each other in the ink tank and oxygen is supplied to the ink. Therefore, the ink is not thickened, and the particles are not generated. In this manner, it is possible to prevent the ink from generating bubbles and generating particles at the same time.

In the ink circulation apparatus, it is preferable that the control unit cuts off the electric power after an amount of dissolved oxygen of the radical polymerization-type UV-curing ink reaches a desired oxygen amount from when a mode is changed to the second mode. According to this, even when the apparatus has not been used for a long period of time, the thickening of the ink can be prevented and the long lifespan of the ink can be obtained.

In the ink circulation apparatus, it is preferable that the control unit obtain in advance a circulation time required for an amount of dissolved oxygen of the radical polymerization-type UV-curing ink to become a desired oxygen amount, and the electric power be cut off after the circulation time has passed from when a mode is changed to the second mode. According to this, an amount of dissolved oxygen in the ink can be set to a desired oxygen amount appropriately.

It is preferable that the ink circulation apparatus further include: a power switch, in which the control unit changes a mode from the first mode to the second mode when the power switch is turned off. In this manner, the invention can be applied even when the electric power of the apparatus is cut off according to the operation of the power switch.

It is preferable that the ink circulation apparatus further include: a supply sub-tank that is provided in the supplying flow path, and retains the radical polymerization-type UV-curing ink so as to be in contact with gas including at least oxygen. According to this, an amount of dissolved oxygen in the ink can be set to a desired oxygen amount in a short period of time.

In the ink circulation apparatus, it is preferable that the oxygen removing unit be provided between the supply sub-tank and the inkjet head. Further, in the ink circulation apparatus, it is preferable that the oxygen removing unit remove oxygen from the radical polymerization-type UV-curing ink using a hollow fiber membrane. According to this, oxygen in the ink can be removed appropriately.

It is preferable that the ink circulation apparatus further include: a discharge sub-tank that is provided in the discharging flow path, and retains the radical polymerization-type UV-curing ink so as to be in contact with gas including at least oxygen. According to this, an amount of dissolved oxygen in the ink can be set to a desired oxygen amount in a short period of time.

It is preferable that the ink circulation apparatus further include: a main tank that accumulates the radical polymerization-type UV-curing ink; a main flow path that communicates with the main tank and the ink tank; and a main pump that is provided in the main flow path and supplies the radical polymerization-type UV-curing ink accumulated in the main tank to the ink tank. According to this, ink in the ink tank can be supplemented.

To achieve the above-described object, there is provided an inkjet recording apparatus, including: an ink circulation apparatus that includes an ink tank that accumulates radical polymerization-type UV-curing ink so as to be in contact with gas including at least oxygen, a supplying flow path that communicates with the ink tank and a supply port of an inkjet head including the supply port to which the radical polymerization-type UV-curing ink is supplied, a nozzle that ejects the radical polymerization-type UV-curing ink, and a discharge port from which the radical polymerization-type UV-curing ink that is not ejected from the nozzle is discharged, a supply pump that is provided in the supplying flow path, and supplies the radical polymerization-type UV-curing ink accumulated in the ink tank to the inkjet head, oxygen removing unit that is provided in the supplying flow path, and removes oxygen from the radical polymerization-type UV-curing ink supplied to the inkjet head, a discharging flow path that communicates with the discharge port of the inkjet head and the ink tank, a collecting pump that is provided in the discharging flow path and collects the radical polymerization-type UV-curing ink discharged from the discharge port to the ink tank, and control unit that stops the oxygen removing unit if a switch is operated, and stops the supply pump and the collecting pump after the radical polymerization-type UV-curing ink is circulated for a predetermined period of time by the supply pump and the collecting pump; an inkjet head; recording unit that lands ink on a recording medium by ejecting ink from a nozzle of the inkjet head while relatively moving the inkjet head and the recording medium; and curing unit that cures the landed ink by irradiating the ink with ultraviolet rays.

According to this aspect, since oxygen is removed from radical polymerization-type UV-curing ink to be supplied to the inkjet head in the first mode, bubbles in the inkjet head can be suppressed from being generated, and dot omission or defective printing may not occur. Further, since before electric power of the apparatus is cut off, ink is circulated without removing oxygen from the ink by changing a mode from the first mode to the second mode, the ink is in contact with the gas including at least oxygen in the ink tank and oxygen is supplied to the ink. Therefore, the ink is not thickened, and the particles are not generated. In this manner, it is possible to prevent the ink from generating bubbles and generating particles at the same time.

In the ink circulation apparatus, it is preferable that the control unit change a mode to the second mode when the recording unit does not eject ink from the nozzle for a long period of time. In this manner, when the recording unit does not eject ink from the nozzle for a long period of time, removing oxygen in the ink is stopped and oxygen is supplied to the ink so that the thickening of the ink can be prevented and the long lifespan of the ink can be obtained.

To achieve the above-described object, there is provided an ink circulation method including: supplying radical polymerization-type UV-curing ink, from an ink tank that accumulates the radical polymerization-type UV-curing ink so as to be in contact with gas including at least oxygen, to a supply port of an inkjet head including the supply port to which the radical polymerization-type UV-curing ink is supplied, a nozzle that ejects the radical polymerization-type UV-curing ink, and a discharge port from which the radical polymerization-type UV-curing ink that is not ejected from the nozzle is discharged; removing oxygen from the radical polymerization-type UV-curing ink to be supplied to the inkjet head; collecting the radical polymerization-type UV-curing ink discharged from the discharge port of the inkjet head to the ink tank; and changing a mode between a first mode of removing oxygen from the radical polymerization-type UV-curing ink by the removing of the oxygen and a second mode of not removing oxygen from the radical polymerization-type UV-curing ink and changing a mode from the first mode to the second mode before electric power of the apparatus is cut off.

According to the invention, it is possible to prevent the ink from generating bubbles and generating particles at the same time so that the ejecting performance can be stabilized and the long lifespan of the ink can be obtained.

DESCRIPTION OF THE PREFERRED EMBODIMENTS

Hereinafter, preferred embodiments of the invention are described with reference to the accompanying drawings.

[Configuration of Ink Circulation Apparatus]

Figure 1:
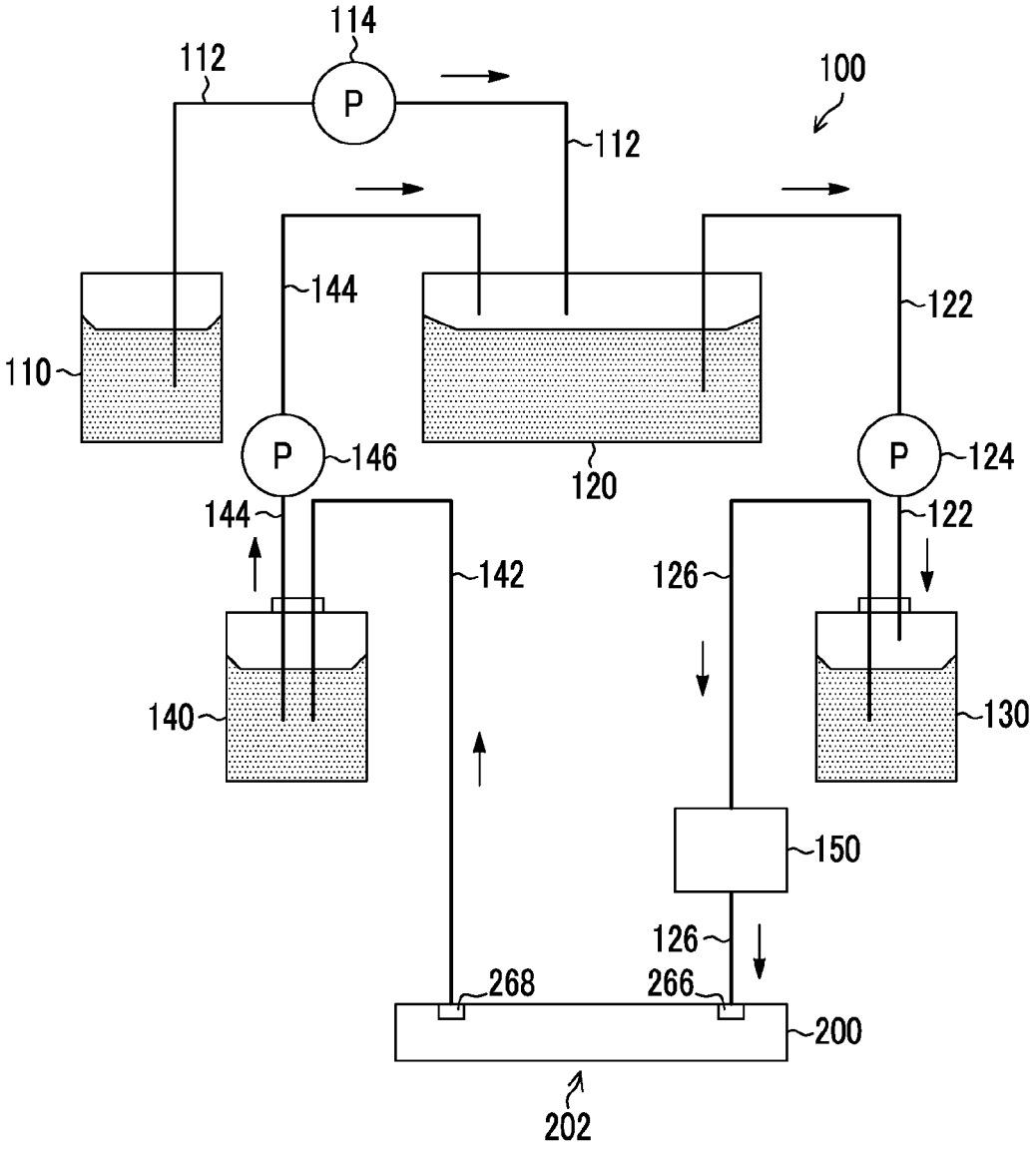
FIG. 1 is a diagram schematically illustrating a configuration of an ink circulation apparatus.

FIG. 1 is a diagram schematically illustrating a configuration of an ink circulation apparatus according to an embodiment of the invention. An ink circulation apparatus 100 circulates ink inside an inkjet head 200 that ejects radical polymerization-type UV-curing ink (hereinafter, simply referred to as "ink"), and includes a main tank 110 that mainly accumulates new ink, a circulating tank 120 that accumulates circulated ink, a supply sub-tank 130 that temporarily accumulates ink supplied from the circulating tank 120 to the inkjet head 200, and a discharge sub-tank 140 that temporarily accumulates ink collected from the inkjet head 200 to the circulating tank 120.

The radical polymerization-type UV-curing ink used in the present embodiment includes an initiator of radical polymerization, as a UV-curing material. In the radical polymerization-type UV-curing ink, oxygen inhibits a polymerizing reaction.

The main tank 110 and the circulating tank 120 (an example of an ink tank) communicate with each other through a first flow path 112 (an example of a main flow path). The first flow path 112 is provided with a first pump 114 (an example of a main pump) that applies pressure into the first flow path 112, and transfers the ink accumulated in the main tank 110 to the circulating tank 120.

The circulating tank 120 is exposed to the atmosphere, and configured so that the ink accumulated in the circulating tank 120 is in contact with the air (an example of the gas including at least oxygen).

The circulating tank 120 and the supply sub-tank 130 communicate with each other through a second flow path 122 (an example of a supplying flow path). The second flow path 122 is provided with a second pump 124 (an example of a supply pump) that applies pressure into the second flow path 122 and transfers ink accumulated in the circulating tank 120 to the supply sub-tank 130.

The supply sub-tank 130 operates as a pressure buffer unit that decreases pulsation of the second pump 124. The supply sub-tank 130 is configured so that the ink accumulated in the supply sub-tank 130 is in contact with the air enclosed in the inside.

The supply sub-tank 130 and an inlet 266 (an example of a supply port) of the inkjet head 200 communicate with each other through a third flow path 126. The third flow path 126 is provided with an oxygen removing apparatus 150 (an example of an oxygen removing unit) that removes oxygen in the ink flowing through the third flow path 126.

The oxygen removing apparatus 150 includes a hollow fiber membrane that gas penetrates but liquid does not substantially penetrate. The oxygen removing apparatus 150 causes the ink to pass on one side of the hollow fiber membrane, and absorbs the ink by a pump on the other side thereof so as to remove dissolved oxygen in the gas in a process in which the ink passes through the hollow fiber membrane. The phrase "liquid does not substantially penetrate the hollow fiber membrane" means that liquid does not penetrate the hollow fiber membrane to a degree in which gas and liquid can be divided and dissolved oxygen can be removed from the ink. In particular, in addition to a case in which liquid does not penetrate the hollow fiber membrane at all, the phrase includes a case in which liquid partially penetrates the hollow fiber membrane (preferably 0.5% or less). In the present embodiment, the hollow fiber membrane of the oxygen removing apparatus 150 is formed to be a cylindrical shape. Further, a method of removing dissolved oxygen in the ink is not limited to a method of using a hollow fiber, and a known method can be used.

The inlet 266 and the outlet 268 of the inkjet head 200 communicate with each other inside the inkjet head 200. The inkjet head 200 includes a plurality of nozzles (reference number 204 in FIGS. 2A and 2B) in the nozzle surface 202 that faces a recording surface of the recording medium, ejects ink from the nozzles, and drops the ink onto the recording surface of the recording medium. The back pressure of the nozzles is determined by a difference between the pressure inside the supply sub-tank 130 and pressure inside the discharge sub-tank 140.

The outlet 268 (an example of a discharge port) of the inkjet head 200 and the discharge sub-tank 140 communicate with each other through a fourth flow path 142.

The discharge sub-tank 140 operates as a pressure buffer unit that decreases pulsation of the third pump 146 described below. Further, the discharge sub-tank 140 is configured so that the ink retained in the inside is in contact with the air enclosed in the inside.

The discharge sub-tank 140 and the circulating tank 120 communicate with each other through a fifth flow path 144 (an example of a discharging flow path). The fifth flow path 144 is provided with the third pump 146 (an example of a collecting pump). The third pump 146 applies pressure inside the fifth flow path 144, and transfers ink discharged from the outlet 268 of the inkjet head 200 through the discharge sub-tank 140 to the circulating tank 120.

Usually, an ink circulating system includes the circulating tank 120, the supply sub-tank 130, the inkjet head 200, the discharge sub-tank 140, the second flow path 122, the third flow path 126, the fourth flow path 142, and the fifth flow path 144, and the ink is circulated in the ink circulating system. The main tank 110 is provided outside the ink circulating system.

[Configuration of Inkjet Head]

Figure 2A:
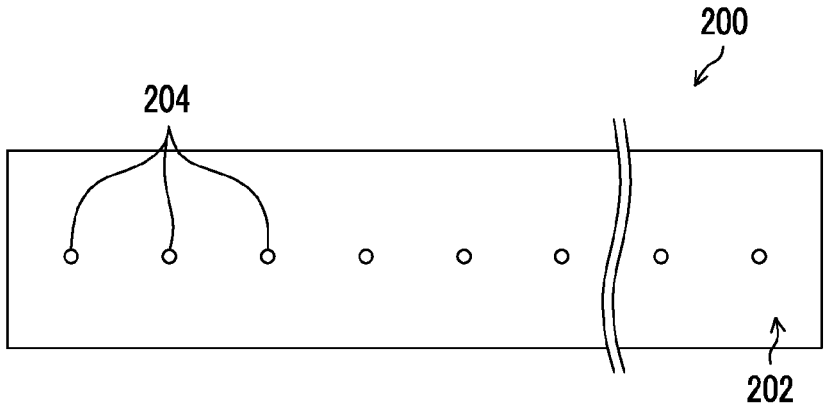
FIGS. 2A and 2B are diagrams illustrating an inkjet head.

FIG. 2A is a diagram illustrating the inkjet head 200 seen from a nozzle surface 202. The nozzle surface 202 of the inkjet head 200 is formed to be a plane surface. A plurality of nozzles 204 which are ink droplet ejection holes are provided in the nozzle surface 202.

Figure 2B:
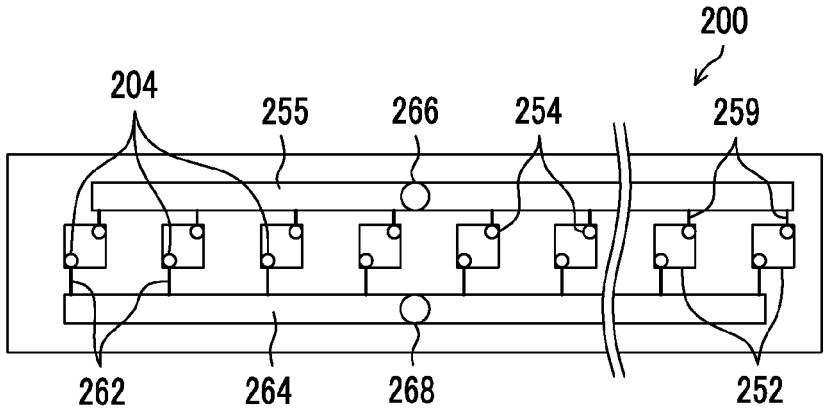
Figure 3:
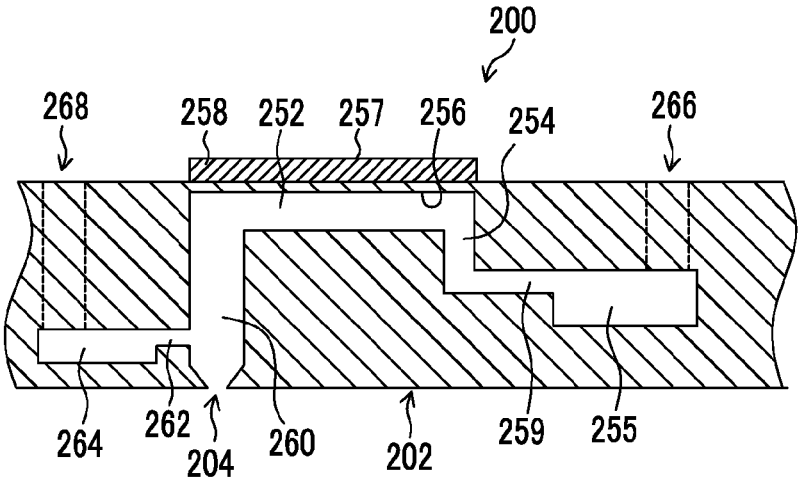
FIG. 3 is a cross-sectional view illustrating a steric structure of an ink chamber unit.

FIG. 2B is a flow path configuration diagram illustrating a flow path configuration inside the inkjet head 200, and FIG. 3 is a cross-sectional view illustrating a space structure of the ink chamber unit. A pressure chamber 252 is provided corresponding to each of the nozzles 204. The plane shape of the pressure chamber 252 is nearly a square shape, and a nozzle 204 and an ink inflow port 254 are provided on both corner ends thereof in a diagonal direction. Each pressure chamber 252 communicates with an individual flow path 259 through the ink inflow port 254, and each individual flow path 259 communicates with a common flow path 255. A nozzle flow path 260 that communicates with each pressure chamber 252 communicates with a common circulating flow path 264 through an individual circulating flow path 262. The inlet 266 and the outlet 268 are provided in the inkjet head 200. The inlet 266 communicates with the common flow path 255, and the outlet 268 communicates with the common circulating flow path 264.

That is, the inlet 266 and the outlet 268 of the inkjet head 200 communicate with each other through an ink flow path (internal flow path) including the common flow path 255, the individual flow path 259, the ink inflow port 254, the pressure chamber 252, the nozzle flow path 260, the individual circulating flow path 262, and the common circulating flow path 264. Therefore, a portion of the ink supplied from the outside of the inkjet head 200 to the inlet 266 is ejected from each nozzle 204, and the remaining ink is discharged from the outlet 268 to the outside of the inkjet head 200 sequentially through the common flow path 255, the individual flow path 259, the nozzle flow path 260, the individual circulating flow path 262, and the common circulating flow path 264.

As illustrated in FIG. 3, it is preferable that the individual circulating flow path 262 is configured to be connected to the vicinity of the nozzle 204 of the nozzle flow path 260. According to this configuration, the ink circulates in the vicinity of the nozzle 204, so that the ink inside the nozzles 204 is prevented from being thickened, and can be stably ejected.

A diaphragm 256 configures the top surface of the pressure chamber 252 and also serves as a common electrode. The piezo-electric element 258 (an example of pressure generating means) including an individual electrode 257 is bonded to the diaphragm 256, and the piezo-electric element 258 is deformed by applying a driving voltage to the individual electrode 257 to eject the ink from the nozzle 204. If the ink is ejected, new ink is supplied from the common flow path 255 through the individual flow path 259 and the ink inflow port 254 to the pressure chamber 252.

In the present example, the piezo-electric element 258 is applied as a generating ejecting force unit of the ink ejected from the nozzle 204 provided on the inkjet head 200, but a thermal method of providing a heater in the pressure chamber 252, using pressure generated by boiling the film with the heat from the heater, and ejecting the ink can also be applied.

[Electrical Configuration of Ink Circulation Apparatus]

Figure 4:
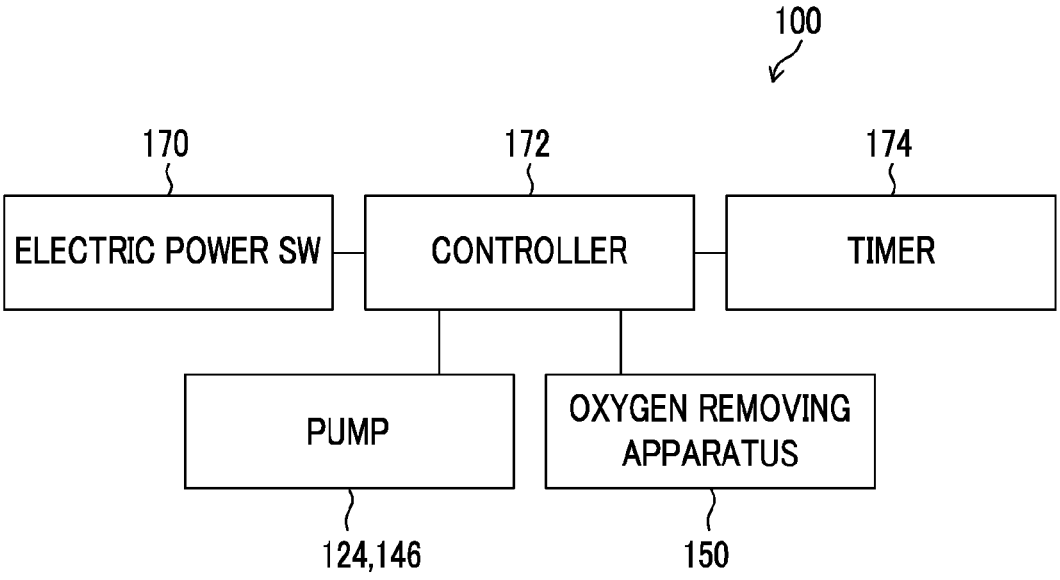
FIG. 4 is a block diagram illustrating an electrical configuration of the ink circulation apparatus.

FIG. 4 is a block diagram illustrating an electrical configuration of the ink circulation apparatus 100. As illustrated in FIG. 4, the ink circulation apparatus 100 includes a power switch (SW) 170, a control unit 172, a timer 174, and the like.

The power switch 170 is a switch for inputting or cutting off electric power of the ink circulation apparatus 100. The user can release the electric power to the ink circulation apparatus 100 and run the ink circulation apparatus 100 by turning on the power switch 170. Further, the user can cut off the electric power of the ink circulation apparatus 100 and stop the ink circulation apparatus 100 by turning off the power switch 170.

The control unit 172 can control the ink circulation apparatus 100 in an integrated manner. The control unit 172 can control the start or the stop of the second pump 124 and the third pump 146 or the start or the stop of the oxygen removing apparatus 150 depending on a state of the power switch 170.

The ink circulation apparatus 100 has a first mode of removing oxygen in the ink by operating the oxygen removing apparatus 150, and a second mode of not removing oxygen in the ink without operating the oxygen removing apparatus 150. The control unit 172 is configured to be capable of switching the first mode and the second mode.

The timer 174 calculates the elapsed time under the instruction of the control unit 172 and outputs the calculated time to the control unit 172.

[Operation of Ink Circulation Apparatus]

An operation (an example of an ink circulation method) of the ink circulation apparatus 100 configured as described above is described with reference to a flowchart of FIG. 5.

(Step S1)

The control unit 172 determines whether the power switch 170 is turned on by the user or not. If the power switch 170 is turned on, the process proceeds to step S2.

(Step S2)

If the power switch 170 is turned on, the control unit 172 drives the second pump 124 and supplies the ink accumulated in the circulating tank 120 to the supply sub-tank 130. The supply sub-tank 130 is sealed, and the ink corresponding to the amount of the ink supplied to the supply sub-tank 130 is transferred from the supply sub-tank 130 to the oxygen removing apparatus 150.

The oxygen removing apparatus 150 removes dissolved oxygen in the ink by flowing ink into the hollow fiber membrane and absorbing the gas by the pump from the outside (first mode, an example of an oxygen removing process). The ink from which dissolved oxygen is removed is supplied to the inlet 266 of the inkjet head 200 (an example of a supply process).

The ink supplied from the inlet 266 to the inkjet head 200 flows through the common flow path 255, each pressure chamber 252 and each nozzle 204, and is discharged from the outlet 268 of the inkjet head 200. The control unit 172 drives the third pump 146, and transfers the ink discharged from the outlet 268 to the discharge sub-tank 140. Further, the discharge sub-tank 140 is sealed. The ink transferred to the discharge sub-tank 140 is collected to the circulating tank 120 (an example of a collecting process).

When the ink accumulated in the circulating tank 120 is decreased, the control unit 172 operates the first pump 114 depending on the decreased amount and supplies the ink from the main tank 110 to the circulating tank 120.

(Step S3)

The control unit 172 determines whether the power switch 170 is turned off by the user or not. If the power switch 170 is turned off, the process proceeds to step S4.

(Step S4)

If the power switch 170 is turned off, the control unit 172 stops the operation of the oxygen removing apparatus 150 (an example of a control process). In this manner, the ink from which oxygen is not removed is supplied to the inkjet head 200 (second mode). Further, the ink is discharged from the inkjet head 200, and the ink from which oxygen is not removed circulates in the ink circulation apparatus 100.

The circulating tank 120, the supply sub-tank 130, and the discharge sub-tank 140 are configured so that the ink accumulated in the inside is in contact with the air. Accordingly, if the ink is circulated with the oxygen removing apparatus 150 stopped, the oxygen in the air penetrates into the ink so that the amount of dissolved oxygen in the ink is increased. Further, the increase rate of the amount of the dissolve oxygen is different depending on the area by which the ink is in contact with the air for each of the circulating tank 120, the supply sub-tank 130, and the discharge sub-tank 140.

Further, the control unit 172 calculates the elapsed time from the stopping of the operation of the oxygen removing apparatus 150 with the timer 174.

(Step S5)

The control unit 172 determines whether the time from the stopping of the operation of the oxygen removing apparatus 150 has exceeded a first circulation time or not, based on the calculated time of the timer 174.

The first circulation time is a period of time for the amount of the dissolved oxygen in the circulated ink to become a desired oxygen amount. The control unit 172 stores the first circulation time in a memory (not illustrated) in advance.

When the time from the stopping of the operation of the oxygen removing apparatus 150 has exceeded the first circulation time, the process proceeds to step S6.

(Step S6)

If the time from the stopping of the operation of the oxygen removing apparatus 150 has exceeded the first circulation time, the control unit 172 stops the circulation of the ink by stopping operations of the second pump 124 and the third pump 146.

Subsequently, all of the electric power of the ink circulation apparatus 100 is cut off (shut down).

In this manner, the ink from which oxygen is removed by the oxygen removing apparatus 150 is generally supplied to the inkjet head 200 as a first mode. Accordingly, the generation of the cavitation in the inkjet head 200 is suppressed, and the stable ejecting performance can be obtained.

If the power switch 170 is turned off by the user, as a second mode, the ink is circulated in a state in which the oxygen removing apparatus 150 is stopped, the circulation of the ink is stopped when the amount of the dissolved oxygen in the ink becomes the desired oxygen amount, and the electric power of the apparatus is cut off. Accordingly, even when the ink circulation apparatus 100 is stopped for a long period of time, the ink can be prevented from being thickened and the long lifespan of the ink can be obtained.

According to the present embodiment, oxygen in the ink is not removed by stopping the oxygen removing apparatus 150 as the second mode, but an embodiment in which oxygen in the ink is not removed by causing the ink to flow through a bypass flow path that bypasses the oxygen removing apparatus 150 is also possible.

Further, the supply sub-tank 130 and the discharge sub-tank 140 may include a vent valve that replaces the air enclosed in the inside. In addition, when replacing the air, it is preferable to prevent the flow of the ink in the third flow path 126 and the fourth flow path 142 by the valve and the like.

[Relationship Between Ratio of Amount of Dissolved Oxygen and the Number of Non-Ejecting Nozzles]

Figure 6:
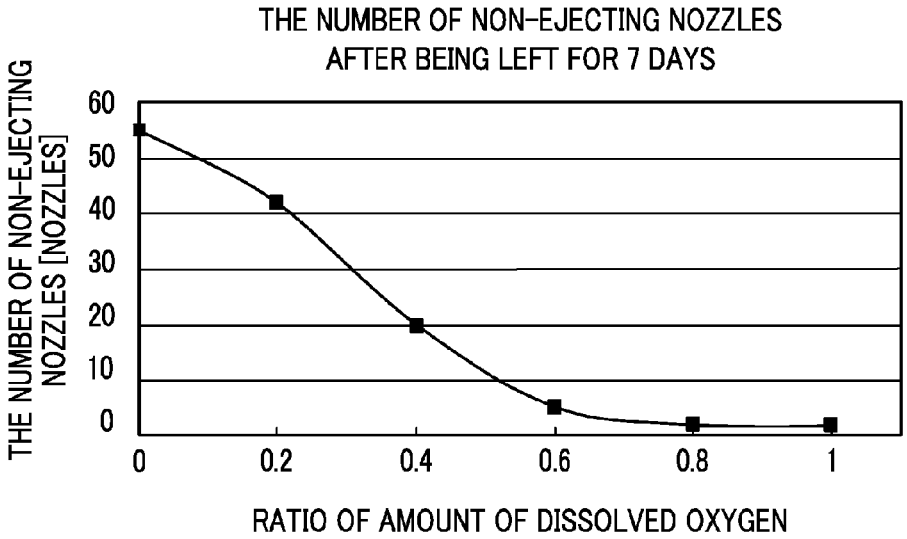
FIG. 6 is a diagram illustrating a relationship between the ratio of an amount of dissolved oxygen and the number of non-ejecting nozzles after being left for 7 days.

FIG. 6 is a diagram illustrating a result of the number of non-ejecting nozzles obtained from a continuous ejection experiment after the radical polymerization-type UV-curing ink for each ratio of an amount of dissolved oxygen filled in the inkjet head 200 and was left for 7 days. Here, when the amount of the dissolved oxygen in the ink from which the gas was not removed under the condition of room temperature and 1 atmosphere pressure was set to be "1", the ratio of the amount of the dissolved oxygen is a ratio of an amount of dissolved oxygen in the ink. In addition, the total number of the nozzles in the inkjet heads 200 was 256, and the initial number of the non-ejecting nozzles for each ratio of the amount of the dissolved oxygen was 0. In addition, in the continuous ejection experiment, the maximum size of an ink droplet that the nozzle 204 could eject was ejected at a frequency of 15 kHz.

As illustrated in FIG. 6, when the ratio of the amount of the dissolved oxygen was 0, that is, when oxygen in the ink was completely removed from the ink, the number of the non-ejecting nozzles after being left for 7 days was 55. Further, when the ratios of the amounts of the dissolved oxygen were "0.2", "0.4", and "0.6", the numbers of the non-ejecting nozzles after being left for 7 days were "42", "20", and "5", respectively. The greater the ratio of the amount of the dissolved oxygen, the smaller the number of the non-ejecting nozzles. Further, when the ratios of the amount of the dissolved oxygen were "0.8" and "1 (saturated state)", the number of the non-ejecting nozzles after being left for 7 days were equally "2".

Figure 5:
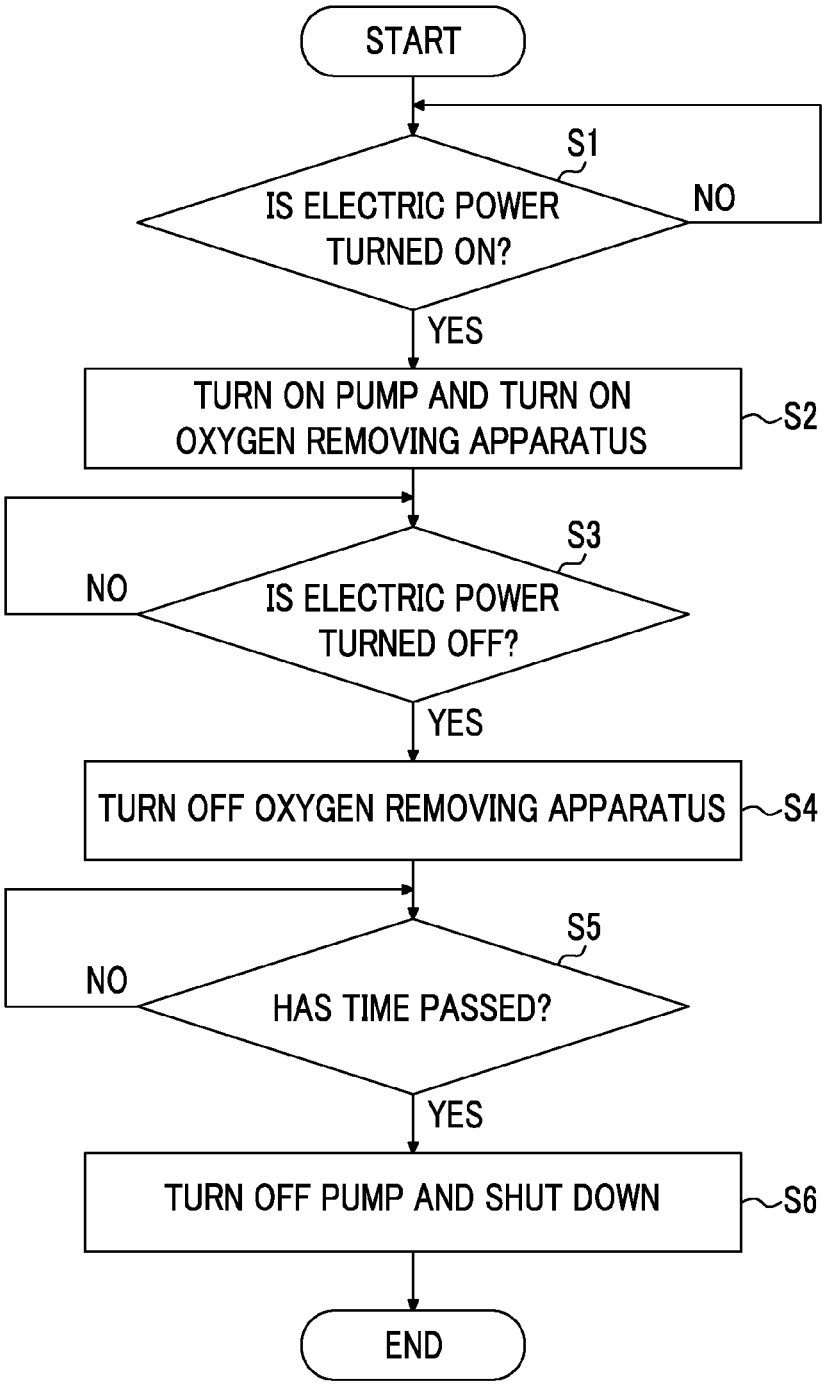
FIG. 5 is a flow chart illustrating an operation of the ink circulation apparatus.

From this result, it was found that it was preferable to circulate the ink until the ratio of the amount of the dissolved oxygen in the ink become equal to or more than 0.8, in step S5 in FIG. 5.

Accordingly, for example, a circulation time for the ratio of the amount of the dissolved oxygen in the ink to become 0.8 or more may be examined in advance, and stored in a memory (not illustrated). It is preferable that the circulation time be stored for each kind of ink.

As described above, the increase rate of the amounts of the dissolved oxygen is different depending on the area by which the ink is in contact with the air for each of the circulating tank 120, the supply sub-tank 130, and the discharge sub-tank 140. In the ink circulation apparatus 100 according to the present embodiment, the circulation time for the ratio of the amount of the dissolved oxygen in the ink to become 0.8 or more was 3 hours.

[Configuration of Inkjet Recording Apparatus]

Subsequently, an inkjet recording apparatus to which the ink circulation apparatus 100 according to the present embodiment is applied is described.

Figure 7:
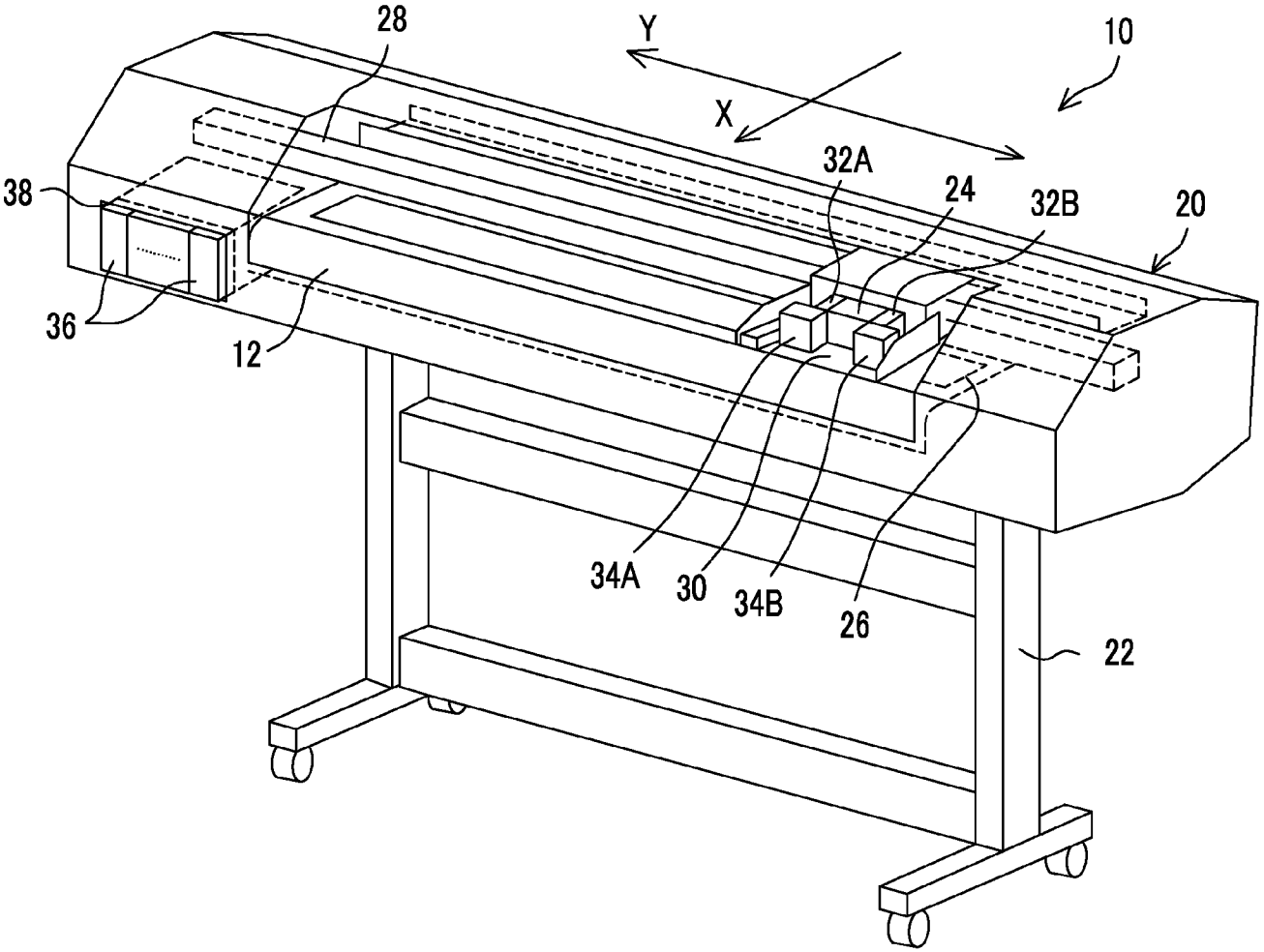
FIG. 7 is a perspective view illustrating an external appearance of an inkjet recording apparatus.

FIG. 7 is a perspective view illustrating an external appearance of an inkjet recording apparatus 10. The inkjet recording apparatus 10 is a wide-format printer that forms a color image on a recording medium 12 by using ultraviolet ray curing ink (UV curing ink). The wide-format printer is an apparatus appropriate for recording a drawing in a wide range such as a large poster and wall surface advertisement for a commercial. Here, a recording medium larger than an A3 size is referred to as a "wide format".

The inkjet recording apparatus 10 includes an apparatus main body 20, and a supporting leg 22 that supports the apparatus main body 20. The apparatus main body 20 is provided with a drop-on-demand-type inkjet head 24 that ejects ink to the recording medium 12, a platen 26 that supports the recording medium 12, a guide mechanism 28 as a head moving unit, and a carriage 30.

The guide mechanism 28 is provided over the platen 26 in a scanning direction (Y direction) perpendicular to a direction (X direction) of transporting the recording medium 12 and parallel to the medium supporting surface of the platen 26. The carriage 30 is supported to be capable of being moved in a reciprocating manner in the Y direction along the guide mechanism 28. The carriage 30 is provided with an inkjet head 24 together with preliminary curing light sources 32A and 32B and the main curing light sources 34A and 34B that radiate ultraviolet ray to the ink on the recording medium 12.

The preliminary curing light sources 32A and 32B are light sources that radiate an ultraviolet ray for performing preliminary curing on ink to a degree in which neighboring droplets are not integrated with each other after ink droplets ejected from the inkjet head 24 are landed on the recording medium 12. The main curing light sources 34A and 34B are light sources that radiate ultraviolet rays for performing additional exposure after preliminary curing and completely curing the ink (main curing) for the last time.

The inkjet head 24, the preliminary curing light sources 32A and 32B, and the main curing light sources 34A and 34B arranged on the carriage 30 are integrally (together) moved together with the carriage 30 along the guide mechanism 28.

Various kinds of media can be used as the recording medium 12, regardless of materials such as paper, unwoven fabric, vinyl chloride, synthetic chemical fibers, polyethylene, polyester, tarpaulin, and regardless of whether it is a permeable medium or a non-permeable medium. The recording medium 12 is fed in a rolled paper shape from the back surface side of the apparatus (see FIG. 8), and wound around a winding roller (not illustrated in FIG. 7, reference number 44 of FIG. 8) on the front surface side of the apparatus after printing. Ink droplets are ejected from the inkjet head 24 to the recording medium 12 transported on the platen 26, and an ultraviolet ray is emitted from the preliminary curing light sources 32A and 32B and the main curing light sources 34A and 34B to the ink droplets attached onto the recording medium 12.

In FIG. 7, a mounting portion 38 of ink cartridges 36 is provided on the front surface on the left of the apparatus main body 20 when viewed from the front side. The ink cartridges 36 are freely-changeable ink supply sources that accumulate the ultraviolet ray curing ink (corresponding to the main tank 110 of FIG. 1). The ink cartridges 36 are arranged respectively corresponding to colors of the ink used in the inkjet recording apparatus 10 according to the present embodiment. Each ink cartridge 36 for each color is connected to the inkjet head 24 through each of independently formed ink supply paths (not illustrated). If the remaining amounts of the colored ink are small, the ink cartridges 36 are changed.

Further, though not illustrated in the drawings, a maintenance unit of the inkjet head 24 is mounted on the right of the apparatus main body 20 viewed from the front side. The maintenance unit is provided with a cap for maintaining the moisture of the inkjet head 24 when printing is not performed and a wiping member (blade, web, and the like) for cleaning the nozzle surface (ink ejecting surface) of the inkjet head 24. The cap that caps the nozzle surface of the inkjet head 24 is provided with an ink receiver that receives ink ejected from the nozzles for maintenance.

<Description of Recording Medium Transporting Path>

Figure 8:
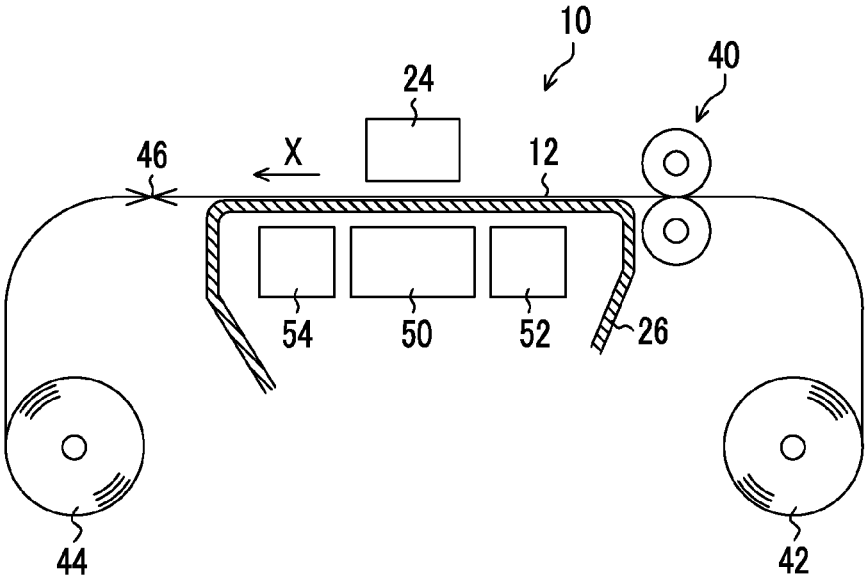
FIG. 8 is a diagram schematically illustrating a transporting path of a recording medium in the inkjet recording apparatus.

FIG. 8 is a diagram schematically illustrating a transporting path of a recording medium in the inkjet recording apparatus 10. As illustrated in FIG. 8, the platen 26 is formed in a reversed tub shape (a shape formed by reversing a tub), and the top surface thereof becomes a supporting surface of the recording medium 12 (referred to as a recording medium supporting surface). A pair of nip rollers 40 which are a recording medium transporting unit intermittently transporting the recording medium 12 is provided at the upstream (on the right in FIG. 8) in the direction (X direction) of transporting the recording medium in the vicinity of the platen 26. The nip rollers 40 transfer the recording medium 12 on the platen 26 in the X direction.

The recording medium 12 that is fed from a feeding roller (transportation feeding roller) 42 included in the recording medium transporting unit in a roller-to-roller method is intermittently transported in the X direction by the pair of nip rollers 40 provided at the entrance of the printing unit (on the upstream of the platen 26 in the direction of transporting the recording medium). The recording medium 12 that has reached the printing unit directly under the inkjet head 24 is subjected to printing by the inkjet head 24, and wound around the winding roller 44 after the printing. The guide 46 of the recording medium 12 is provided at the downstream of the printing unit in the direction of transporting the recording medium.

The printing unit is provided with a temperature adjusting unit 50 for adjusting the temperature of the recording medium 12 during the printing on the back surface (a surface opposite to the surface supporting the recording medium 12) of the platen 26 at a position facing the inkjet head 24. If the recording medium 12 at the time of printing is adjusted to be in a predetermined temperature, a physical property such as the viscosity and the surface tension of the ink droplets landed on the recording medium 12 has a value as desired, and a desired dot diameter can be obtained. Further, if necessary, a heat pre-adjustment unit 52 may be provided at the upstream of the temperature adjusting unit 50, and a heat after-adjustment unit 54 may be provided at the downstream of the temperature adjusting unit 50.

<Description of Inkjet Head>

Figure 9:
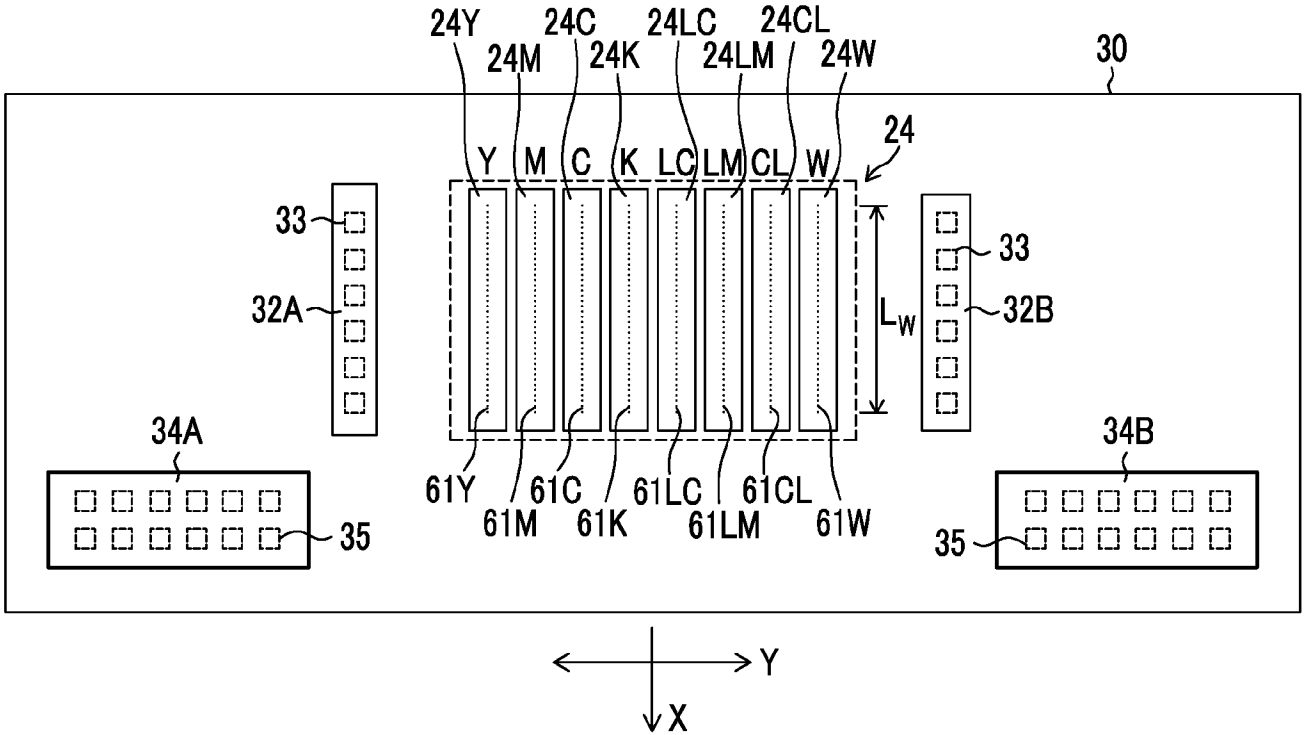
FIG. 9 is a plane perspective view illustrating an exemplary arrangement formation on a carriage.

FIG. 9 is a plane perspective view illustrating an exemplary arrangement formation of the inkjet head 24, the preliminary curing light sources 32A and 32B, and the main curing light sources 34A and 34B arranged on the carriage 30.

The inkjet head 24 is provided with head modules 24Y, 24M, 24C, 24K, 24LC, 24LM, 24CL, and 24W for ink of each color (an example of radical polymerization-type UV-curing ink of a plurality of colors) of yellow (Y), magenta (M), cyan (C), black (K), light cyan (LC), light magenta (LM), transparent ink (CL), and white (W).

Each of the head modules 24Y, 24M, 24C, 24K, 24LC, 24LM, 24CL, and 24W is provided with each of nozzle rows 61Y, 61M, 61C, 61K, 61LC, 61LM, 61CL, and 61W for ejecting ink of each color together with an ink inlet and an ink outlet (not illustrated, corresponding to the inlet 266 and the outlet 268 of the inkjet head 200). That is, each of the head modules 24Y, 24M, 24C, 24K, 24LC, 24LM, 24CL, and 24W correspond to the inkjet head 200 illustrated in FIG. 1. Accordingly, the ink circulation apparatus 100 illustrated in FIG. 1 is provided with each of the head modules 24Y, 24M, 24C, 24K, 24LC, 24LM, 24CL, and 24W.

In FIG. 9, nozzle rows are illustrated with dotted lines, and individual nozzles are not illustrated. Further, in the description below, the nozzle rows 61Y, 61M, 61C, 61K, 61LC, 61LM, 61CL, and 61W may be collectively referred to as a nozzle row indicated by reference number 61.

Further, the kinds of ink colors (the number of colors) or the combination of the colors is not limited to the present embodiment. For example, an embodiment in which the nozzle rows LC and LM are omitted, an embodiment in which the nozzle rows CL and W are omitted, and an embodiment in which a nozzle row that ejects ink of a special color is added can be possible. In addition, an arrangement order of the nozzle rows for each color is not particularly limited.

In each of the nozzle rows 61, a plurality of nozzles are arranged in one row (linearly) in the X direction at constant intervals. In the inkjet head 24 according to the present embodiment, an arrangement interval (nozzle pitch) of the nozzles included in each of the nozzle rows 61 is 254 μm (100 dpi), the number of nozzles included in one nozzle row 61 is 256, and the total length Lw of the nozzle row 61 is approximately 65 mm (254 μm×255=64.8 mm).

Further, the ejection frequency is 15 kHz, and the amount of ejection droplets can be divided into three kinds of 10 μl, 20 μl, and 30 μl by the change of drive waveforms. That is, three sizes of dots of a small dot, a middle dot, and a large dot can be formed.

As an ink ejection method of the inkjet head 24, a method (piezojet method) of ejecting ink droplets by deformation of a piezo-electric element (piezoelectric actuator) is employed. In addition to the embodiment (electrostatic actuator method) using an electrostatic actuator as an ejection energy generating element, an embodiment (thermal jet method) in which bubbles are generated by heating ink using a heating unit (heating element) such as a heater, and ink droplets are ejected by the pressure can be employed.

<With Respect to Arrangement of UV Irradiation Apparatus>

As illustrated in FIG. 9, the preliminary curing light sources 32A and 32B are arranged on both of the left and right sides in the scanning direction (Y direction) of the inkjet head 24. Further, the main curing light sources 34A and 34B are arranged at the downstream of the inkjet head 24 in the direction (X direction) of transporting the recording medium.

The ink droplets ejected from the nozzles of the inkjet head 24 and landed on the recording medium 12 is irradiated with ultraviolet rays for preliminary curing by the preliminary curing light source 32A (or 32B) that passes over the ink droplets right after the ink droplets are landed. Further, the ink droplets on the recording medium 12 that passes the printed region of the inkjet head 24 along with intermittent transport of the recording medium 12 are irradiated with ultraviolet rays for main curing by the main curing light sources 34A and 34B.

Further, the preliminary curing light sources 32A and 32B, and the main curing light sources 34A and 34B are always turned on while the inkjet recording apparatus 10 performs a printing operation.

<With Respect to Configuration Example of Preliminary Curing Light Source>

As illustrated in FIG. 9, the preliminary curing light sources 32A and 32B (an example of curing unit) each have structures in which a plurality of UV-LED elements 33 are lined. The two preliminary curing light sources 32A and 32B have the common structure. According to the present embodiment, LED element arrangement in which six UV-LED elements 33 are arranged in one row in the X direction, as the preliminary curing light sources 32A and 32B is described, but the number and the arrangement formation of the LED elements are not limited thereto. For example, a structure in which the plurality of LED elements are arranged in a matrix shape in the X and Y directions is also possible.

The six UV-LED elements 33 are lined so that the UV irradiation can be performed on a region having the same width as a width Lw of the nozzle row of the inkjet head 24 at a time.

<With Respect to Configuration Example of Main Curing Light Source>

As illustrated in FIG. 9, the main curing light sources 34A and 34B (an example of the curing unit) each have a structure in which a plurality of UV-LED elements 35 are lined. The two main curing light sources 34A and 34B have the common structure. According to the present embodiment, as the main curing light sources 34A and 34B, LED element arrangement (6×2) has a matrix shape with six UV-LED elements 35 in the Y direction and two UV-LED elements 35 in the X direction.

The arrangement of the UV-LED elements 35 in the X direction relates to the swath width described below. The arrangement is determined so that the UV irradiation can be performed on a region having a 1/n width (n is a positive integer) of the width Lw of the nozzle row at a time, in one scanning by the carriage 30. In FIG. 9, the UV-LED elements 35 are arranged so that irradiation can be performed on a region having a ½ width (n=2) of the width Lw of the nozzle row.

In addition, the number and the arrangement formation of the LED element of the main curing light sources 34A and 34B are not limited by the embodiment illustrated in FIG. 9. Further, light sources of the preliminary curing light sources 32A and 32B and the main curing light sources 34A and 34B are not limited to the UV-LED elements 33 and 35, and UV lamps or the like can be used.

[Electrical Configuration of Inkjet Recording Apparatus]

Figure 10:
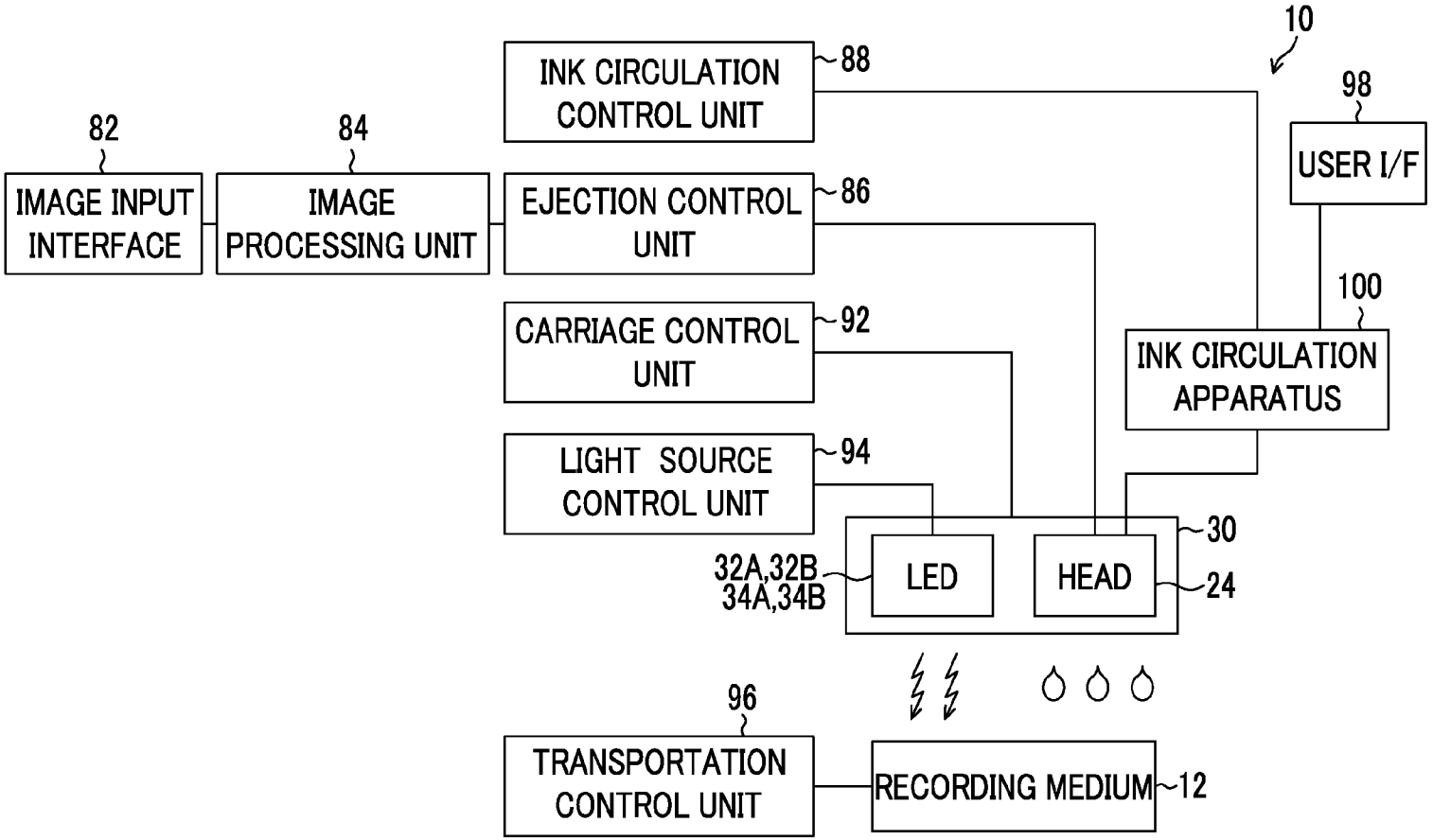
FIG. 10 is a block diagram illustrating an electrical configuration of the inkjet recording apparatus.

FIG. 10 is a block diagram illustrating an electrical configuration of the inkjet recording apparatus 10. As illustrated in FIG. 10, the inkjet recording apparatus 10 includes an image input interface 82, an image processing unit 84, an ejection control unit 86, an ink circulation control unit 88, a carriage control unit 92, a light source control unit 94, a transportation control unit 96, and a user interface 98.

The image input interface 82 acquires image data via a wired or wireless communication interface. The image processing unit 84 performs a desired image process on input image data and converts the image data into print data (dot data). In general, the dot data is generated by performing color conversion processing and half-toning processing on multi-level image data.

Various kinds of known means such as an error diffusion method, a dither method, a threshold matrix method and a density pattern method can be applied as half-toning processing means. The half-toning processing converts gray-scale image data having an M value (M≥3) into gray-scale image data having an N value (N<M). As the easiest example, a conversion to binary (on/off of dots) dot image data is performed. In the half-toning processing, multi-level quantization corresponding to the kinds of the dot size (for example, three kinds such as a large dot, a middle dot, and a small dot) can be performed.

The binary or multi-level image data (dot data) obtained as described above is used as ink ejecting data (drop control data) that controls driving (on)/non-driving (off) of each nozzle, and also the droplet amount (dot size) in the case of the multi-level image.

The ejection control unit 86 generates an ejection control signal and controls the inkjet head 24 based on the dot data generated in the image processing unit 84. In this manner, ink is ejected from a corresponding nozzle of the inkjet head 24.

The ink circulation control unit 88 controls the first pump 114, the second pump 124, the third pump 146, the oxygen removing apparatus 150, and the oxygen supplying apparatus 160 of the ink circulation apparatus 100, which are provided for each ink color, and the ink is circulated inside the head modules 24Y, 24M, 24C, 24K, 24LC, 24LM, 24CL, and 24W of the inkjet head 24 for each color. Further, the ink circulation control unit 88 circulates ink of each color regardless of whether the ink is ejected from the inkjet head 24 or not.

The carriage control unit 92 controls the moving of the carriage 30 in the Y direction and performs reciprocating scanning of the inkjet head 24 in the Y direction.

The light source control unit 94 controls the amount of light generated from the UV-LED elements 33 and 35 of the preliminary curing light sources 32A and 32B and the main curing light sources 34A and 34B.

The transportation control unit 96 drives the nip rollers 40 and the winding roller 44, and controls the transport of the recording medium 12. The recording medium 12 transported on the platen 26 is intermittently transferred in the X direction in the unit of the swath width in accordance with the reciprocating scanning of the inkjet head 24 in the Y direction by the carriage 30. The recording unit is configured with the ejection control unit 86, the carriage control unit 92, and the transportation control unit 96, and the recording unit performs recording on the recording medium 12 by ejecting the ink from the nozzle of the inkjet head 24 while relatively moving the inkjet head 24 and the recording medium 12.

The user interface (I/F) 98 includes an input unit that enables the user to operate the inkjet recording apparatus 10, an output unit that displays various types of alerts to the user, and a power switch for releasing or cutting off the electric power of the inkjet recording apparatus 10. Whether the power switch is turned on or off is input to the control unit 172 of the ink circulation apparatus 100.

In the inkjet recording apparatus 10 configured as described above, since the ink is transferred to each of the head modules 24Y, 24M, 24C, 24K, 24LC, 24LM, 24CL, and 24W after oxygen in the ink is removed, the generation of the non-ejecting nozzles in each of the nozzle rows 61Y, 61M, 61C, 61K, 61LC, 61LM, 61CL, and 61W can be prevented and the ejection stabilization can be obtained.

[Operation of Inkjet Recording Apparatus]

Figure 11:
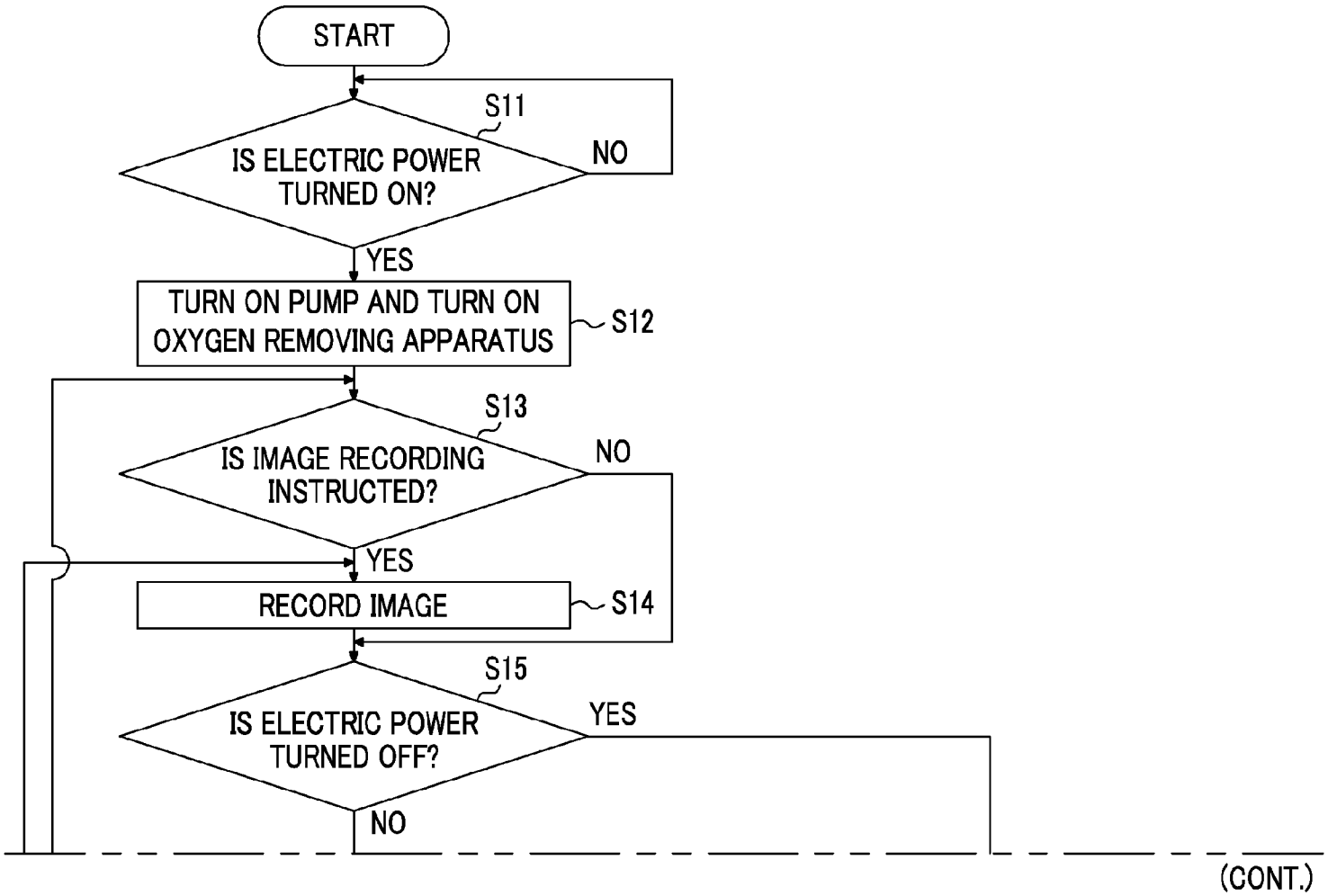
FIG. 11 is a flow chart illustrating an operation of the inkjet recording apparatus.

The operation of the inkjet recording apparatus 10 configured as described above will be described with reference to the flowchart of FIG. 11.

(Step S11)

The control unit 172 of the ink circulation apparatus 100 determines whether the electric power of the inkjet recording apparatus 10 is turned on or not by the user interface 98. In the case in which the electric power is turned on, the process proceeds to step S12.

(Step S12)

If the electric power is turned on, the control unit 172 supplies ink from the circulating tank 120 to the inkjet head 200 by driving the second pump 124 (an example of a supply process), and collects ink from the inkjet head 200 to the circulating tank 120 by driving the third pump 146 (an example of a collecting process). The control unit 172 starts the oxygen removing apparatus 150, and removes oxygen in the ink to be supplied to the inkjet head 200 (first mode, an example of an oxygen removing process).

When the ink accumulated in the circulating tank 120 is decreased, the control unit 172 operates the first pump 114 depending on the decreased amount, and supplies ink from the main tank 110 to the circulating tank 120.

(Step S13)

Subsequently, it is determined whether it is instructed to record an image by the user interface 98 or not. If instructed, the process proceeds to step S14, and if not, the process proceeds to step S15.

(Step S14)

Image recording is performed according to the instruction to record an image. That is, the inkjet recording apparatus 10 transports the recording medium 12 by the transportation control unit 96, and causes the carriage 30 to perform reciprocating scanning in the Y direction by the carriage control unit 92. The ejection control unit 86 controls the inkjet head 24 based on the output data of the image processing unit 84 and ejects ink to the recording surface of the recording medium 12. The light source control unit 94 controls the UV-LED elements 33 and 35 of the preliminary curing light sources 32A and 32B and the main curing light sources 34A and 34B, and radiates ultraviolet rays to the ink droplets ejected to the recording medium 12.

(Step S15)

The control unit 172 determines whether the electric power of the inkjet recording apparatus 10 is turned off by the user interface 98 or not. If the electric power is turned off, the process proceeds to step S21, and if the electric power is not turned off, the process proceeds to step S16.

(Step S16)

Subsequently, it is determined that whether a long period of time has passed from the end of the image recording or not (an example of case when ink is not ejected from a nozzle for a long period of time). Here, the long period of time refers to a period of time during which an amount of dissolved oxygen in the ink is decreased by the oxygen removing apparatus 150, and the ink becomes thickened, by continuously circulating the ink. If a long period of time has not passed from the end of the image recording, the process proceeds to step S13, and the process repeats in the same manner. If a long period of time has passed, the process proceeds to step S17.

(Step S17)

The control unit 172 stops the operation of the oxygen removing apparatus 150. That is, the ink is circulated without removing oxygen in the ink (second mode). Further, the elapsed time from when the operation of the oxygen removing apparatus 150 is stopped is calculated by the timer 174 (an example of a time calculation process).

(Step S18)

The control unit 172 determines whether the electric power of the inkjet recording apparatus 10 is turned off by the user interface 98 or not. If the electric power is turned off, the process proceeds to step S22, and if the electric power is not turned off, the process proceeds to step S19.

(Step S19)

Subsequently, it is determined that whether the image recording is instructed by the user interface 98 or not. If instructed, the process proceeds to step S20, and if not, the process returns to step S18, and repeats the operation in the same manner.

(Step S20)

The control unit 172 restarts the stopped operation of the oxygen removing apparatus 150. That is, the ink is supplied to the inkjet head 200 after oxygen in the ink is removed (first mode). Thereafter, the process proceeds to step S14, and the image recording is performed.

(Step S21)

In step S15, if it is determined that the electric power is turned off, the control unit 172 stops the operation of the oxygen removing apparatus 150 (an example of an oxygen removing process). That is, the ink is circulated without removing oxygen in the ink (second mode). Further, the elapsed time after the operation of the oxygen removing apparatus 150 is stopped is calculated by the timer 174 (an example of a time calculating process).

(Step S22)

The control unit 172 determines whether the time from when the operation of the oxygen removing apparatus 150 is stopped has exceeded the first circulation time or not based on the calculated time of the timer 174.

The first circulation time refers to a period of time for an amount of dissolved oxygen in the ink in circulation to become a desired oxygen amount similarly to step S5 of FIG. 5. Here, the first circulation time is a period of time when the amount of the dissolved oxygen in the ink becomes 0.8 or more, and it was 3 hours in the ink circulation apparatus 100 according to the present embodiment. The control unit 172 stores the first circulation time in the memory (not illustrated) in advance.

If the time from when the operation of the oxygen removing apparatus 150 is stopped has exceeded the first circulation time, the process proceeds to step S23.

(Step S23)

The control unit 172 stops the second pump 124 and the third pump 146, and stops the circulation of the ink (an example of a circulation stopping process). Further, the electric power of the inkjet recording apparatus 10 is turned off and shut down.

In this manner, the ink from which oxygen is removed by the oxygen removing apparatus 150 is generally supplied to the inkjet head 200. Accordingly, the cavitation is suppressed from being generated inside the inkjet head 200, and a stable ejecting performance can be obtained.

If the electric power of the inkjet recording apparatus 10 is turned off by the user, after the ink is circulated for a predetermined period of time in a state in which the oxygen removing apparatus 150 is stopped, the circulation of the ink is stopped when the dissolved oxygen in the ink becomes the desired oxygen amount and the electric power is cut off. Accordingly, even when the inkjet recording apparatus 10 is stopped for a long period of time, the thickening of the ink can prevented and the long lifespan of the ink can be obtained.

When the image recording is not performed for a long period of time with the electric power of the inkjet recording apparatus 10 being turned on, the ink is circulated in a state in which the oxygen removing apparatus 150 is stopped so that the thickening of the ink is suppressed. For example, even when a standby mode or a sleep mode in which an image is not formed is started with the electric power of the inkjet recording apparatus 10 being turned on, the ink may be circulated in a state in which the oxygen removing apparatus 150 is stopped.

The present specification is described with reference to the inkjet recording apparatus that ejects colored ink suitable for the application of the graphic print. However, the present invention is not limited thereto, and can be applied to an image forming apparatus that ejects resist ink (heat resistant covering material) for printed wiring, dispersion liquid in which conductive fine particles are dispersed in a dispersion medium, ink used for manufacturing a color filter, and the like.

The technical scope of the invention is not limited to the scope described in the aforementioned embodiment. The configuration according to each embodiment and the like can be appropriately combined with each embodiment within the range not departing from the scope of the invention.

This application claims priority under 35 U.S.C. §119 of Japanese Patent application JP 2013-079606, filed on Apr. 5, 2013, the entire contents of which are hereby incorporated by reference.

What is claimed is:

1. An ink circulation apparatus, comprising:

an ink tank that accumulates radical polymerization-type UV-curing ink so as to be in contact with gas including at least oxygen;

a supplying flow path that communicates with the ink tank and a supply port of an inkjet head including the supply port to which the radical polymerization-type UV-curing ink is supplied, a nozzle that ejects the radical polymerization-type UV-curing ink, and a discharge port from which the radical polymerization-type UV-curing ink that is not ejected from the nozzle is discharged;

a supply pump that is provided in the supplying flow path, and supplies the radical polymerization-type UV-curing ink accumulated in the ink tank to the inkjet head;

an oxygen removing unit that is provided in the supplying flow path, and removes oxygen from the radical polymerization-type UV-curing ink;

a discharging flow path that communicates with the discharge port of the inkjet head and the ink tank;

a collecting pump that is provided in the discharging flow path, and collects the radical polymerization-type UV-curing ink discharged from the discharge port to the ink tank; and a control unit that changes a mode between a first mode of removing oxygen from the radical polymerization-type UV-curing ink by the oxygen removing unit and a second mode of not removing oxygen from the radical polymerization-type UV-curing ink, and changes a mode from the first mode to the second mode before electric power of the apparatus is cut off.

2. The ink circulation apparatus according to claim 1, wherein the control unit cuts off the electric power after an amount of dissolved oxygen of the radical polymerization-type UV-curing ink becomes a desired oxygen amount from when a mode is changed to the second mode.

3. The ink circulation apparatus according to claim 2, wherein the control unit obtains in advance a circulation time required for an amount of dissolved oxygen of the radical polymerization-type UV-curing ink to become a desired oxygen amount, and wherein the electric power is cut off after the circulation time has passed from when a mode is changed to the second mode.

4. The ink circulation apparatus according to claim 1, further comprising:

a power switch, wherein the control unit changes a mode from the first mode to the second mode when the power switch is turned off.

5. The ink circulation apparatus according claim 3, further comprising:

a power switch, wherein the control unit changes a mode from the first mode to the second mode when the power switch is turned off.

6. The ink circulation apparatus according to claim 1, further comprising:

a supply sub-tank that is provided in the supplying flow path, and retains the radical polymerization-type UV-curing ink so as to be in contact with gas including at least oxygen.

7. The ink circulation apparatus according to claim 6, wherein the oxygen removing unit is provided between the supply sub-tank and the inkjet head.

8. The ink circulation apparatus according to claim 1, wherein the oxygen removing unit includes a hollow fiber membrane that is penetrated by gas but is not substantially penetrated by liquid.

9. The ink circulation apparatus according to claim 1, further comprising:

a discharge sub-tank that is provided in the discharging flow path, and retains the radical polymerization-type UV-curing ink so as to be in contact with gas including at least oxygen.

10. The ink circulation apparatus according to claim 1, further comprising:

a main tank that accumulates the radical polymerization-type UV-curing ink;

an main flow path that communicates with the main tank and the ink tank; and a main pump that is provided in the main flow path, and supplies the radical polymerization-type UV-curing ink accumulated in the main tank to the ink tank.

11. An inkjet recording apparatus, comprising:

the ink circulation apparatus according to claim 1;

the inkjet head;

a recording unit that lands ink on a recording medium by ejecting ink from a nozzle of the inkjet head while relatively moving the inkjet head and the recording medium; and a curing unit that cures the landed ink by irradiating the ink with ultraviolet rays.

12. The inkjet recording apparatus according to claim 10, wherein the control unit changes a mode to the second mode when the recording unit does not eject ink from the nozzle for a long period of time.

13. An ink circulation method using the ink circulation apparatus according to claim 1, comprising:

supplying radical polymerization-type UV-curing ink to the supply port;

removing oxygen from the radical polymerization-type UV-curing ink to be supplied to the inkjet head;

collecting the radical polymerization-type UV-curing ink discharged from the discharge port of the inkjet head to an ink tank; and changing a mode between a first mode of removing oxygen from the radical polymerization-type UV-curing ink and a second mode of not removing oxygen from the radical polymerization-type UV-curing ink and changing a mode from the first mode to the second mode before electric power of the apparatus is cut off.

14. An ink circulation method, comprising:

supplying radical polymerization-type UV-curing ink, from an ink tank that accumulates the radical polymerization-type UV-curing ink so as to be in contact with gas including at least oxygen, to a supply port of an inkjet head including the supply port to which the radical polymerization-type UV-curing ink is supplied, a nozzle that ejects the radical polymerization-type UV-curing ink, and a discharge port from which the radical polymerization-type UV-curing ink that is not ejected from the nozzle is discharged;

removing oxygen from the radical polymerization-type UV-curing ink to be supplied to the inkjet head;

collecting the radical polymerization-type UV-curing ink discharged from the discharge port of the inkjet head to the ink tank; and changing a mode between a first mode of removing oxygen from the radical polymerization-type UV-curing ink and a second mode of not removing oxygen from the radical polymerization-type UV-curing ink and changing a mode from the first mode to the second mode before electric power of the apparatus is cut off.

* * * * *